US009239056B2

(12) United States Patent
Miyazaki et al.

(10) Patent No.: US 9,239,056 B2
(45) Date of Patent: Jan. 19, 2016

(54) PUMP IMPELLER AND SUBMERSIBLE PUMP HAVING SUCH PUMP IMPELLER

(75) Inventors: Yoshiaki Miyazaki, Tokyo (JP); Ritsuko Miyazaki, legal representative, Tokyo (JP); Junya Kawabata, Tokyo (JP); Hiromi Sakacho, Tokyo (JP); Masashi Obuchi, Tokyo (JP); Yoichi Nakamura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 858 days.

(21) Appl. No.: 13/518,975

(22) PCT Filed: Dec. 22, 2010

(86) PCT No.: PCT/JP2010/073122

§ 371 (c)(1),
(2), (4) Date: Aug. 16, 2012

(87) PCT Pub. No.: WO2011/081066

PCT Pub. Date: Jul. 7, 2011

(65) Prior Publication Data

US 2013/0022450 A1 Jan. 24, 2013

(30) Foreign Application Priority Data

Dec. 28, 2009 (JP) ..... 2009-298573

(51) Int. Cl.

| | |
|---|---|
| ***F01D 3/00*** | (2006.01) |
| ***F04D 7/04*** | (2006.01) |
| ***F04D 29/22*** | (2006.01) |

(52) U.S. Cl.

CPC ..... *F04D 7/04* (2013.01); *F04D 29/225* (2013.01)

(58) Field of Classification Search

CPC ..... F04D 7/04; F04D 7/02; F04D 29/225; F04D 29/2244; F04D 29/007; F04D 29/2255; F04D 29/2266; F04D 29/16; F04D 29/662; F04D 1/00; F04D 1/14

USPC ..... 415/181

See application file for complete search history.

(56) References Cited

U.S. PATENT DOCUMENTS 2,655,868 A * 10/1953 Lindau et al. ..... 415/71
4,575,312 A * 3/1986 Erikson ..... 416/179

(Continued)

FOREIGN PATENT DOCUMENTS

| | | |
|---|---|---|
| CN | 2303952 | 1/1999 |
| CN | 2323180 | 6/1999 |
| CN | 201170213 | 12/2008 |
| JP | 2005-36778 | 2/2005 |

(Continued)

OTHER PUBLICATIONS

International Search Report issued Mar. 29, 2011 in International (PCT) Application No. PCT/JP2010/073122.

*Primary Examiner* — Dwayne J White
*Assistant Examiner* — Jason Fountain
(74) *Attorney, Agent, or Firm* — Wenderoth, Lind & Ponack, L.L.P.

(57) ABSTRACT

A non-clogging type pump impeller includes: a fluid passage provided in an approximately cylindrical body and connecting a suction port to a discharge port. The fluid passage has a vortex shape as viewed from an axial direction. A first recess, which is sunk downwardly in the axial direction, is formed on a first end surface of the approximately cylindrical body so as to surround a boss. A second recess, which is sunk upwardly in the axial direction, is formed on a second end surface of the approximately cylindrical body so as to surround the suction port. At least one communication hole provides fluid communication between the first recess and the second recess. Sewage in the second recess is introduced into the first recess through the at least one communication hole to thereby effectively remove an air pocket trapped on the first end surface of the impeller and in the first recess.

9 Claims, 9 Drawing Sheets

A-A

(56) References Cited

U.S. PATENT DOCUMENTS

| | | | | |
|---|---|---|---|---|
| 5,542,817 | A * | 8/1996 | Brandt | 415/58.2 |
| 6,752,590 | B2 * | 6/2004 | Serio | 415/112 |
| 7,837,431 | B2 * | 11/2010 | Nishi et al. | 415/71 |
| 2011/0164968 | A1 * | 7/2011 | Okizoe et al. | 415/206 |

FOREIGN PATENT DOCUMENTS

| | | |
|---|---|---|
| JP | 2005-214046 | 8/2005 |
| JP | 2006-90279 | 4/2006 |
| JP | 2006-291938 | 10/2006 |
| JP | 2009-103078 | 5/2009 |

* cited by examiner

E–E

A–A

B-B

C–C

D–D

PUMP IMPELLER AND SUBMERSIBLE PUMP HAVING SUCH PUMP IMPELLER

BACKGROUND OF INVENTION

1. Technical Field

The present invention relates to a pump impeller suitable for use in a submersible pump for sewage treatment, and more particularly to an impeller capable of effectively removing air trapped in a region on a rear-surface side of the impeller. The present invention also relates to a submersible pump having such impeller.

2. Background Art

Conventionally, there is a submersible pump for use in sewage treatment installed in a manhole. Such a submersible pump for sewage treatment is installed with its suction pipe located in a depression which is slightly below a floor surface in the manhole, as shown in, for example, a patent document 1. In such a submersible pump, if a water level in the manhole is not enough, air pocket (i.e., trapped air) is formed on an inner surface of a pump chamber which houses an impeller therein or on a rear-surface side (i.e., an upper-surface side) of the impeller. This air pocket can be a cause of idling of the pump. Moreover, the air pocket may prevent sufficient supply of liquid (i.e., the sewage) to a mechanical seal of the pump, thus causing insufficient lubrication. In order to prevent such problems, the conventional submersible pump has an air vent valve near a ceiling of the pump chamber. This air vent valve can remove the air pocket remaining on the inner surface of the pump chamber or on the rear-surface side of the impeller.

The patent document 1 discloses, as one example of conventional submersible pump, a vortex type having a relatively flat main shroud of the impeller (the shroud is a plate that covers the rear-surface side). In this type of submersible pump, even if the air pocket is formed on the main shroud of the impeller, such air pocket can be removed sufficiently through the above-described air vent valve.

As another example of conventional submersible pump, there is a submersible pump having a non-clogging type impeller, as shown in a patent document 2. This non-clogging type impeller has a single vane with a fluid passage formed in its approximately cylindrical body. The fluid passage has a vortex shape as viewed from an axial direction of the impeller. In order to prevent the pump from being clogged with foreign substances when pumping the sewage, the fluid passage has a cross section with a substantially constant dimension such that the foreign substances are less likely to be caught in the impeller.

CITATION LIST

Patent Literatures

Patent document 1: Japanese laid-open patent publication No. 2005-214046

Patent document 2: Japanese laid-open patent publication No. 2009-103078

TECHNICAL PROBLEM

In the above-described non-clogging type impeller, the body has lightning recesses formed on an upper end and a lower end thereof, in order to make the impeller as light as possible and to make the thickness of the single vane as uniform as possible. Therefore, this type of impeller with the recesses may have a complex geometry with non-flat upper and lower end surfaces. Consequently, the air pocket formed on the lower-end surface side is likely to remain on a bottom of the recess that is sunk axially upwardly, and the air pocket may not be removed sufficiently by the air vent valve or agitation by rotation of the impeller (the bottom of the recess is an end of the recess, i.e., an upper end of the recess that is sunk axially upwardly and a lower end of the recess that is sunk axially downwardly). Moreover, the air pocket is also created on the upper-end surface side. Specifically, the air pocket is formed in a region enclosed by the upper-end surface of the impeller and an intermediate casing, i.e., a region on the upper-end surface of the impeller and/or a region in the recess sunk axially downwardly. This air pocket also cannot be removed sufficiently by the air vent valve and the agitation by the rotation of the impeller. Accordingly, it is necessary for the non-clogging type impeller with such geometry to have structure capable of easily removing the air pockets created on the upper-end surface side and the lower-end surface side of the impeller.

SUMMARY OF INVENTION

The present invention has been made in view of the above. An object of the present invention is to provide a pump impeller capable of removing the air pocket effectively to thereby prevent failures, such as idling of the pump and malfunction of the mechanical seal due to lack of lubrication. Further, another object of the present invention is to provide a submersible pump having such a pump impeller.

Solution to Problem

In order to solve the above drawbacks, the present invention provides a non-clogging type pump impeller (1) including: an approximately cylindrical body (10) having an attachment boss (12) formed on a center of one end surface (11) of the body (10); a suction port (13) provided on other end surface (15) of the body (10), the one end surface (11) and the other end surface (15) being arranged along an axial direction; a discharge port (14) having an opening on a side surface (16) of the body (10); and a fluid passage (18) provided in the body (10) and connecting the suction port (13) to the discharge port (14), the fluid passage (18) having a vortex shape as viewed from the axial direction. A first recess (21) is formed on the one end surface (11) of the body (10) so as to surround the boss (12), the first recess (21) is sunk in the axial direction. The pump impeller (1) has at least one communication hole (23) providing fluid communication between the first recess (21) and a region around the suction port (13) on the other end surface (15) of the body (10). A second recess (22), which is sunk in the axial direction, may be formed on the other end surface (15) of the body (10) so as to surround the suction port (13), and the communication hole (23) may provide fluid communication between the first recess (21) and the second recess (22).

According to the present invention, the pump impeller has the first recess that is formed on the one end surface of the approximately cylindrical body so as to surround the boss, and the communication hole providing fluid communication between first recess and the region on the other end surface around the suction port. In a pump casing enclosing the impeller therein, liquid around the suction port is introduced into the first recess on the rear-surface side through the communication hole. This liquid can remove air pockets stuck in and around the first recess effectively. Therefore, in the non-clogging type impeller having complicated end-surface geometry, the communication hole can prevent failures that could be caused by the air pocket on the end surface, such as idling of the pump and malfunction of the mechanical seal due to lack of lubrication.

Further, according to the present invention, the existence of the communication hole can allow pressure on the one end surface side (rear-surface side) of the impeller disposed in the pump casing to be approximately equal to pressure on the other end surface side (front-surface side). This can reduce an amount of the liquid flowing backward from the discharge port on the side surface of the impeller to the suction port on the front side through a gap between the pump casing and the impeller, as compared with a conventional impeller. Therefore, the backflow of the liquid delivers less foreign substances to the end surface on the suction side of the impeller. As a result, the foreign substances are hardly stuck in a gap between a suction-side end portion of the impeller and the pump casing, and possibility of pump failure can be reduced.

The communication hole according to the present invention is located so as to avoid the fluid passage in the impeller and extends from the one end surface to the other end surface. These end surfaces are arranged along the axial direction. The purpose of providing the communication hole is different from that of a through-hole extending from a back side of an impeller to a fluid passage in a typical pump impeller because the through-hole is provided for reducing pressure difference between back-surface pressure (i.e., pressure on the back side of the impeller) and front-surface pressure (i.e., pressure on fluid passage surface).

It is preferable to provide plural communication holes (23), because these holes can introduce the liquid into the first recess more effectively to thereby enhance the effect of air pocket removal.

In the pump impeller according to the present invention, it is preferable that the communication hole (23*b*) extend from a bottom portion (21*a*) of the first recess (21) to a bottom portion (22*a*) of the second recess (22) and that the communication hole (23*b*) be located in a position where the thinnest wall is formed between the bottom portion (21*a*) of the first recess (21) and the bottom portion (22*a*) of the second recess (22), i.e., a position where a distance between the bottom portion (21*a*) of the first recess (21) and the bottom portion (22*a*) of the second recess (22) is minimized. This arrangement can facilitate formation of the communication hole.

A submersible pump according to the present invention includes the above pump impeller (1), a pump casing (32) housing the pump impeller (1) therein, and a motor (52) for driving the pump impeller (1). The pump impeller having the above structure can prevent failures that could be caused by the air pocket, such as idling of the pump and malfunction of the mechanical seal due to lack of lubrication. Moreover, the foreign substances are hardly stuck in the gap between the impeller and the pump casing, and possibility of failure of the submersible pump can be reduced.

The above reference numerals between parentheses show reference numerals of corresponding elements in below-described embodiment as one example of the present invention.

Advantageous Effects of Invention

The pump impeller according to the present invention and the submersible pump having such pump impeller can remove the air pocket formed on the rear side of the impeller effectively. Therefore, failures, such as idling of the pump and malfunction of the mechanical seal due to lack of lubrication, can be prevented.

DESCRIPTION OF EMBODIMENTS

Figure 1A:
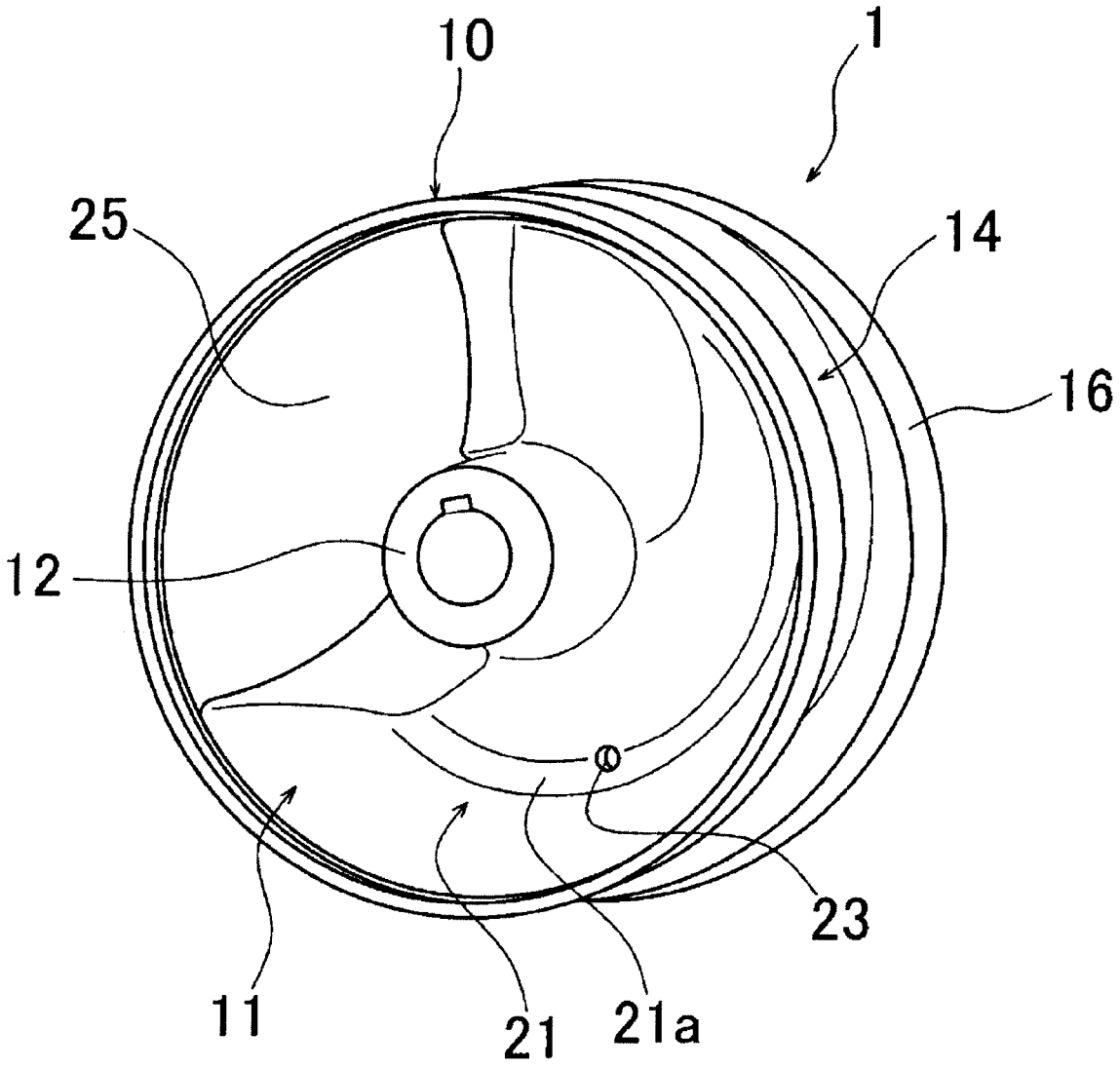
FIG. 1A is a perspective view of a pump impeller according to an embodiment of the present invention as viewed from an upper-surface side (i.e., a rear-surface side)
Figure 1B:
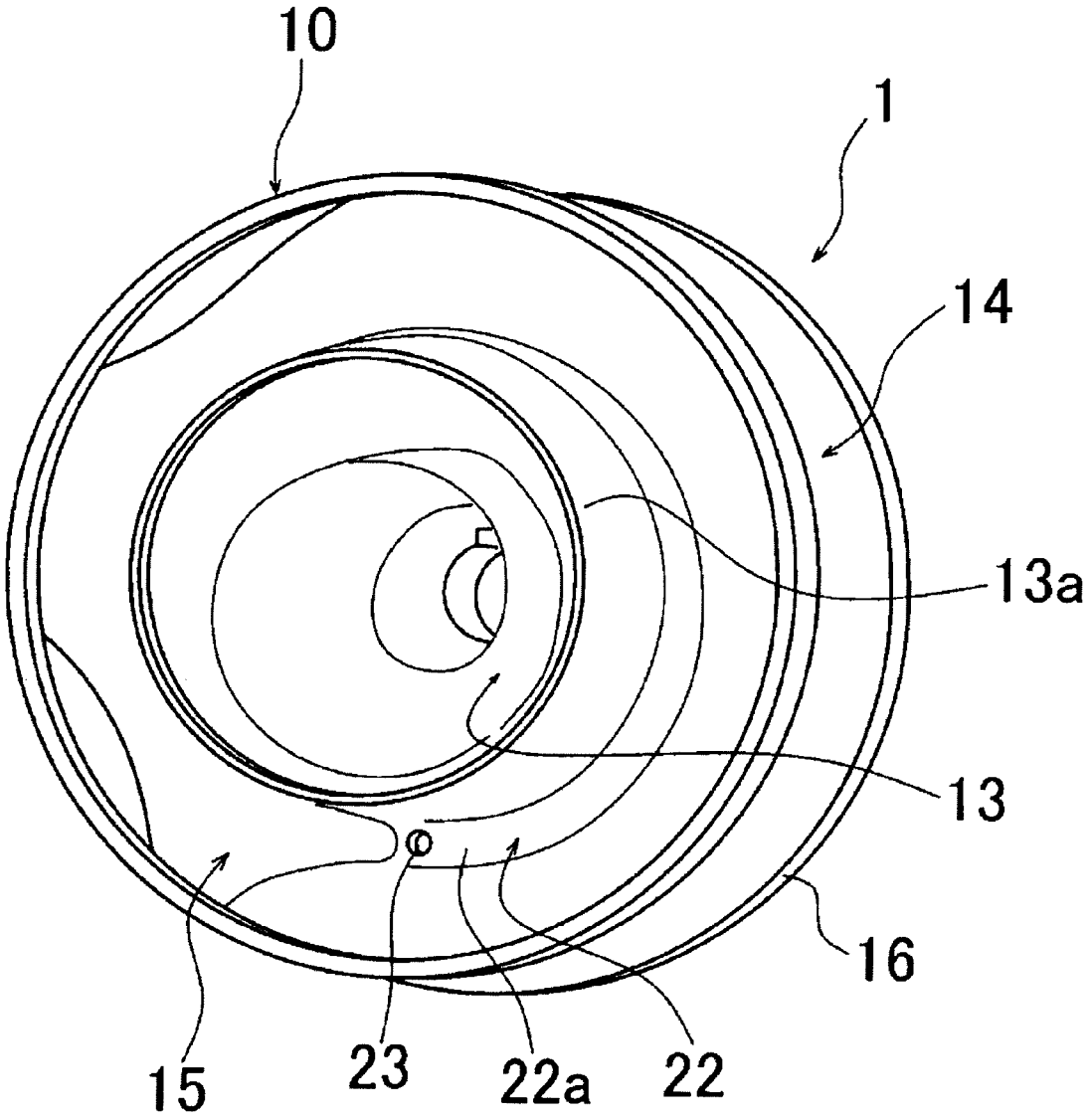
FIG. 1B is a perspective view of the pump impeller according to the embodiment of the present invention as viewed from a lower-surface side (i.e., a front-surface side)
Figure 2:
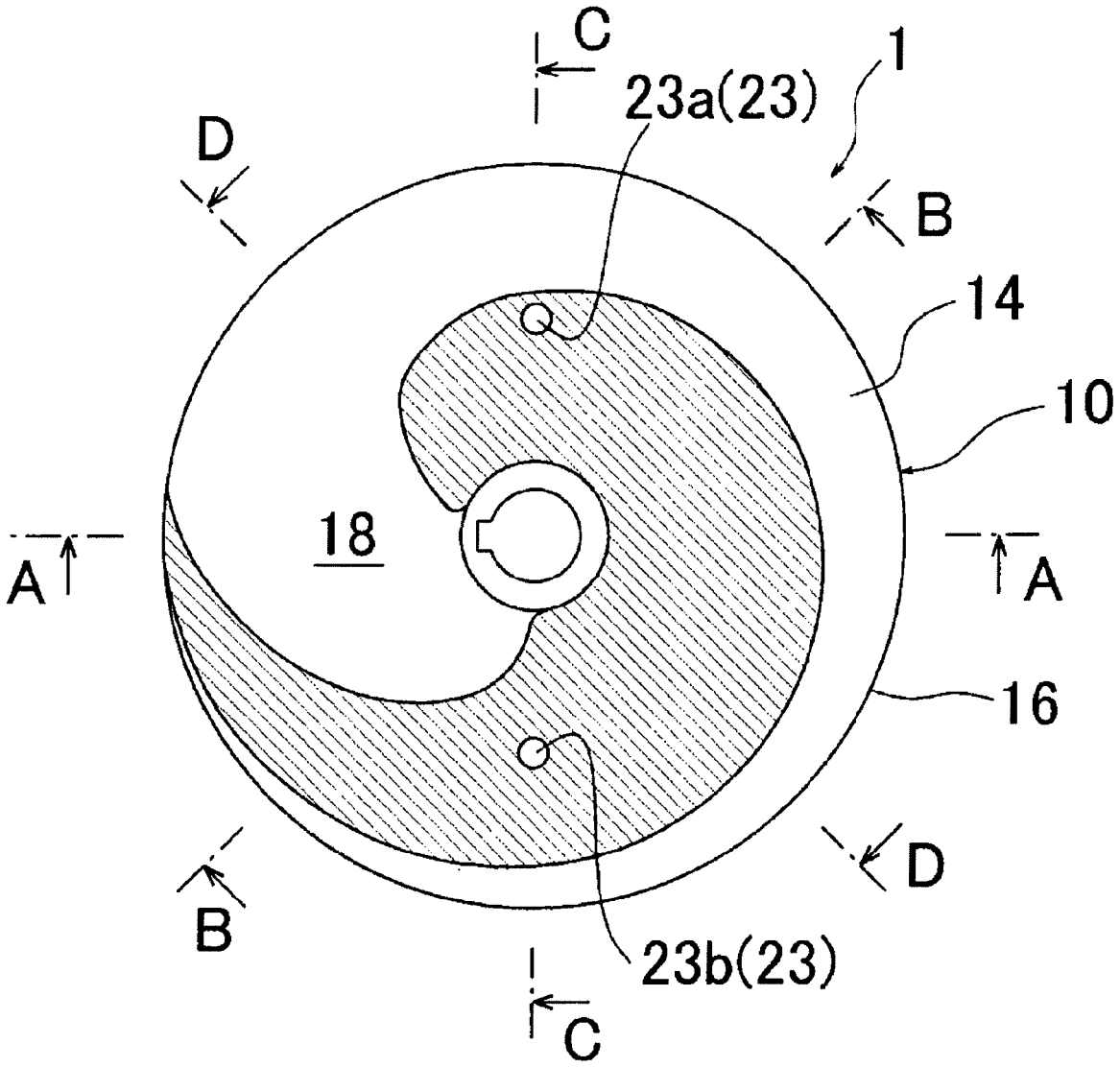
FIG. 2 is a view showing interior geometry of the pump impeller and showing a cross section perpendicular to an axial direction (a cross section taken along line E-E in FIG. 3A)
Figure 3A:
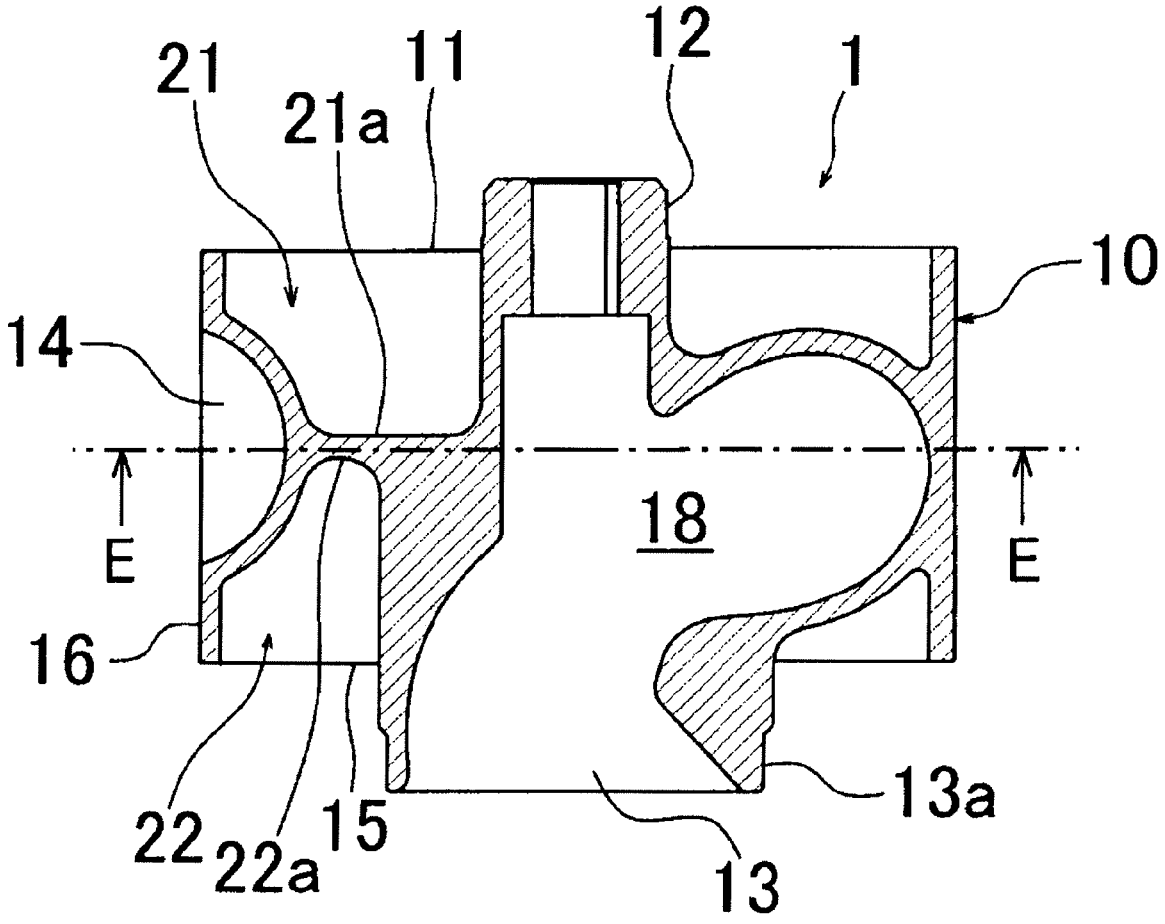
FIG. 3A is a view showing interior geometry of the pump impeller and showing a cross section taken along line A-A in FIG. 2.
Figure 3B:
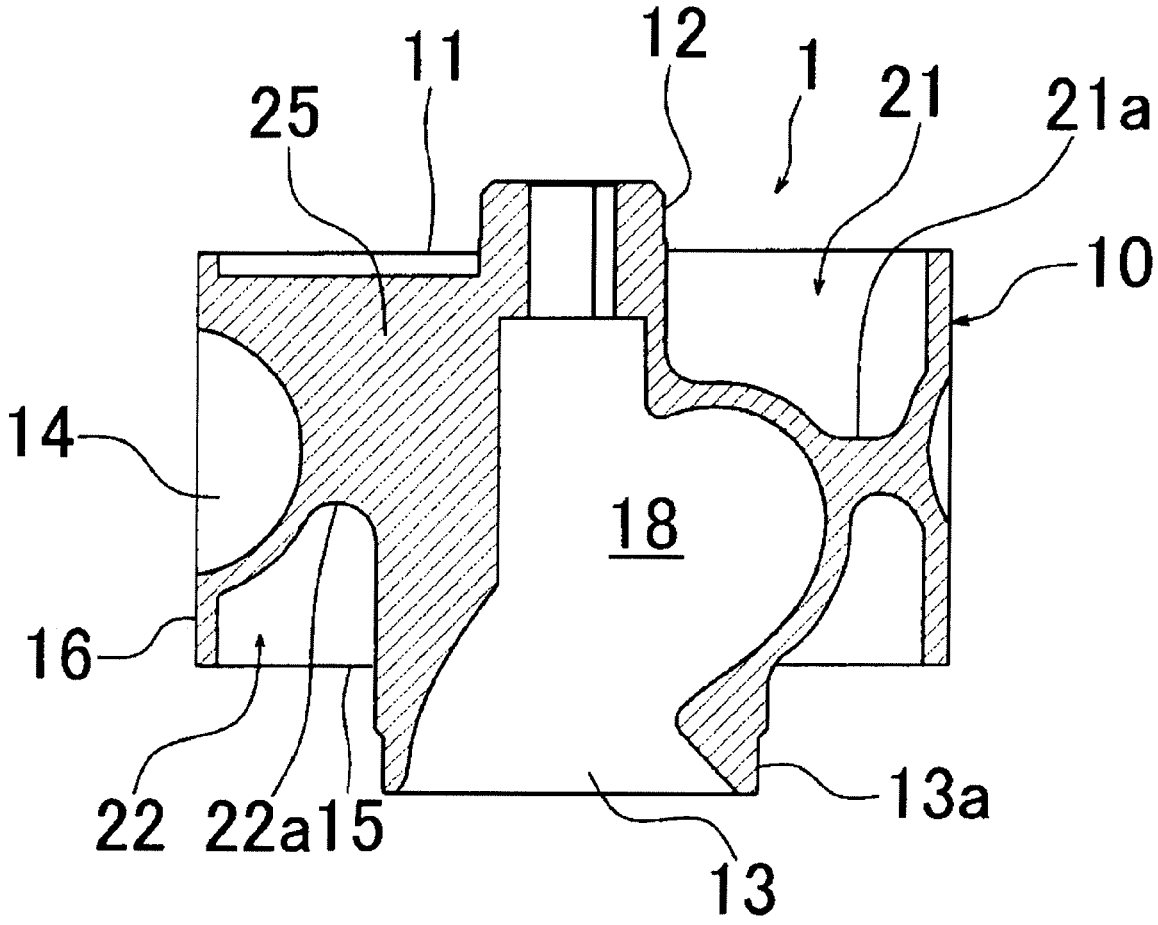
FIG. 3B is a view showing interior geometry of the pump impeller and showing a cross section taken along line B-B in FIG. 2.
Figure 3C:
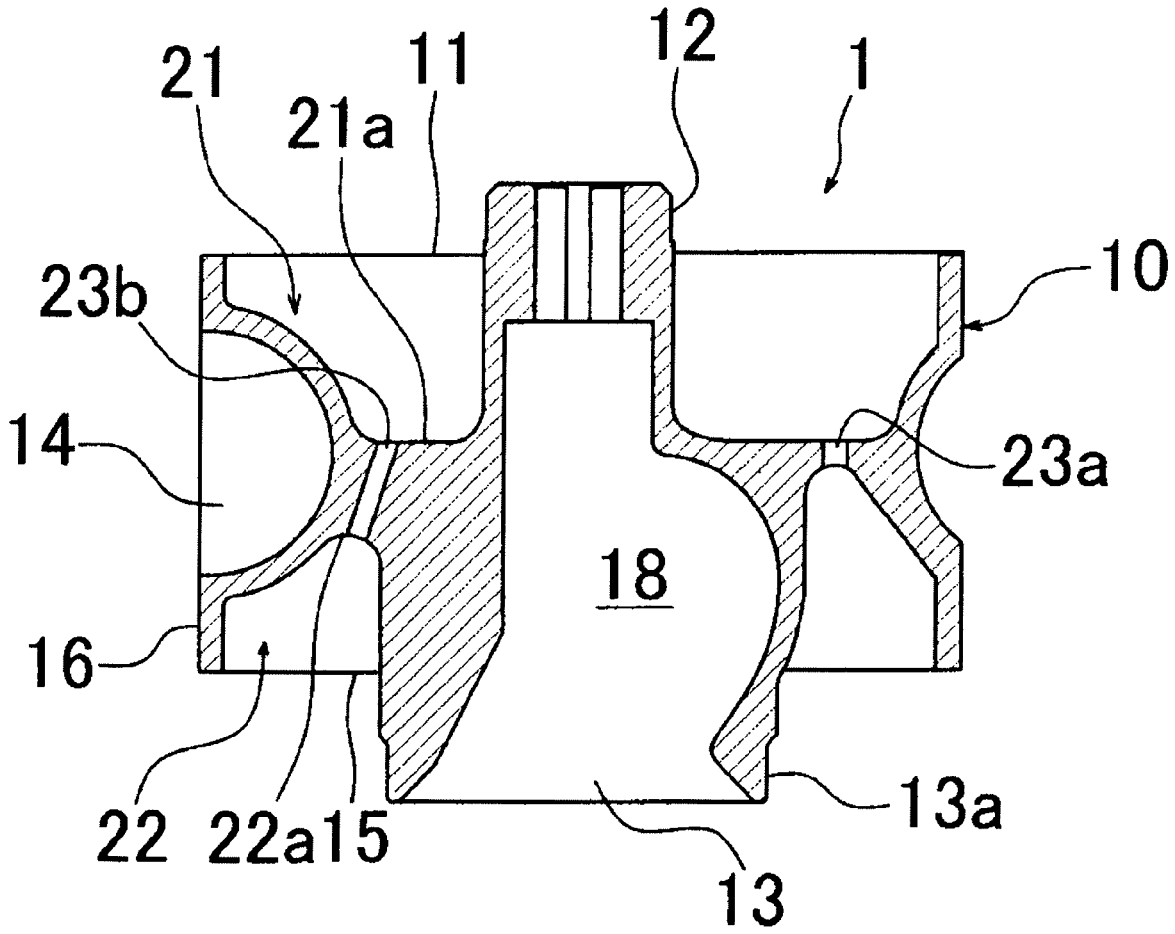
FIG. 3C is a view showing interior geometry of the pump impeller and showing a cross section taken along line C-C in FIG. 2.
Figure 3D:
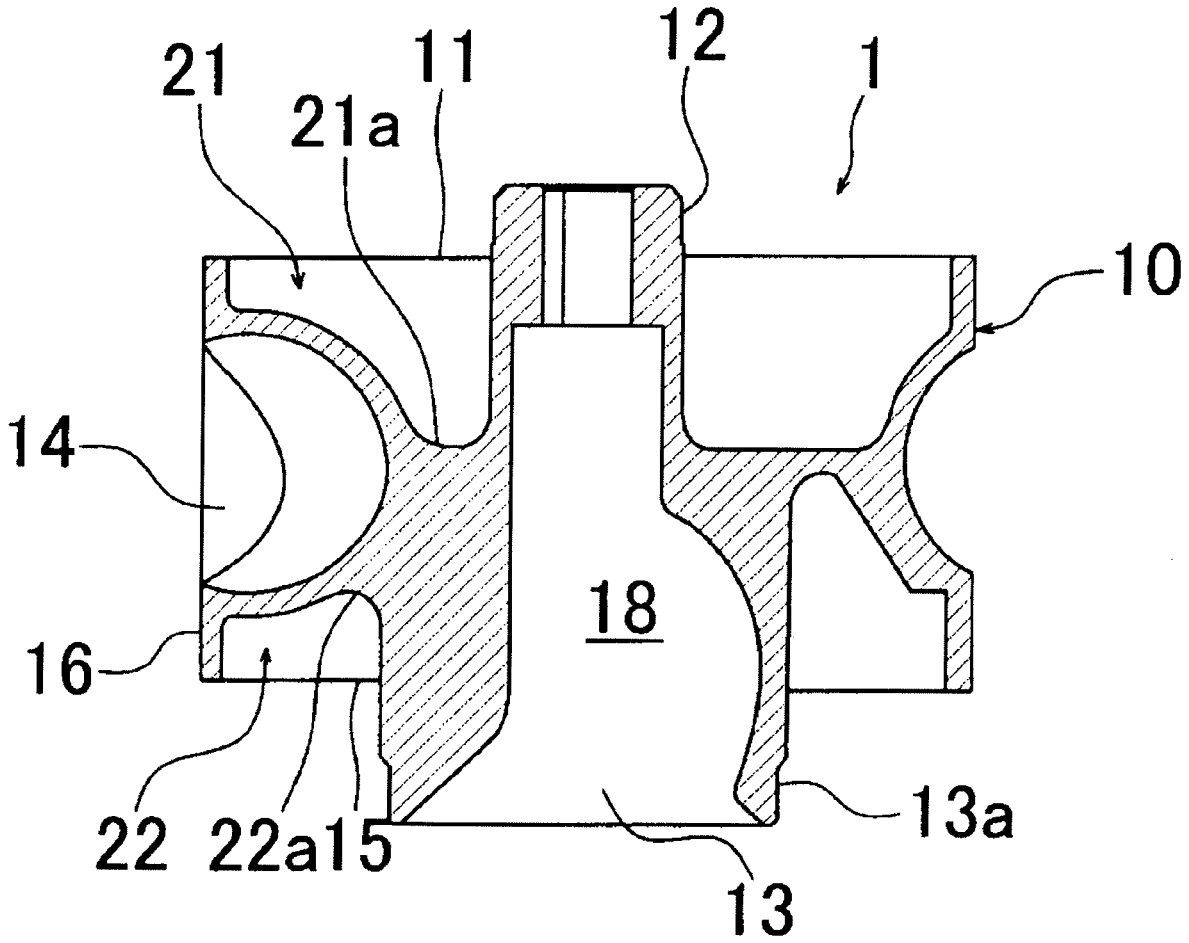
FIG. 3D is a view showing interior geometry of the pump impeller and showing a cross section taken along line D-D in FIG. 2.

Embodiments of the present invention will be described in detail below with reference to the attached drawings. FIG. 1A and FIG. 1B are views each showing an example of a pump impeller according to an embodiment of the present invention. More specifically, FIG. 1A is a perspective view of the pump impeller as viewed from an axially upper-surface side (i.e., a rear-surface side), and FIG. 1B is a perspective view of the pump impeller as viewed from a lower-surface side (i.e., a front-surface side). FIG. 2 and FIG. 3A through FIG. 3D are views each showing interior geometry of the impeller. More specifically, FIG. 2 shows a cross section perpendicular to an axial direction (a cross section taken along line E-E in FIG. 3A), and FIG. 3A through FIG. 3D show views taken along lines A-A, B-B, C-C, and D-D in FIG. 2.

As shown in the drawings, an impeller 1 according to one embodiment is a non-clogging type impeller having a fluid passage with a substantially constant diameter. The impeller 1 has an approximately cylindrical body 10. A boss 12, which is a cylindrical protrusion, is formed on a center of an axially-upper-end surface (i.e., a rear surface) 11 of the body 10. The boss 12 is attached to a drive shaft 55 (see FIG. 4) of a submersible pump 30, which will be described later. A suction port 13 is provided on an axially-lower-end surface (i.e., an end surface on a front side) 15 of the body 10. A discharge port 14 is provided on a side surface 16 of the body 10. The suction port 13 has an approximately circular opening formed inside a cylindrical portion 13*a* which is a cylindrical protrusion formed at a center of the lower-end surface 15. The discharge port 14 is provided as a recess formed on the side surface 16 and having a cross section in a shape of an approximately semicircular arc. This discharge port 14 extends along a circumferential direction of the side surface 16 substantially in its entirety. A fluid passage 18 is formed in the body 10 so as to provide fluid communication between the suction port 13 and the discharge port 14. The fluid passage 18 has a vortex shape as viewed from an axial direction, i.e., a spiral shape extending in the axial direction such that a distance from a central axis increases from the suction port 13 toward the discharge port 14. The fluid passage 18 has an approximately circular cross section whose diameter is substantially constant such that foreign substances are less likely to be stuck in the fluid passage 18.

A first recess 21, which is sunk downwardly in the axial direction, is formed on the upper-end surface 11 of the body 10 so as to surround the boss 12. The first recess 21 is a hollow in the shape of approximately circular arc formed around the boss 12. As shown in FIG. 3A through FIG. 3D, the first recess 21 is located so as to avoid the fluid passage 18 such that a wall thickness of the body 10 between the first recess 21 and the fluid passage 18 is substantially uniform. The first recess 21 has its bottom portion 21*a*, which is the deepest portion, located near an axial center of the impeller 1. A second recess 22, which is sunk upwardly in the axial direction, is formed on the lower-end surface 15 of the body 10 so as to surround the suction port 13. The second recess 22 is an annular hollow formed around the suction port 13. As with the first recess 21, the second recess 22 is located so as to avoid the fluid passage 18 such that the wall thickness of the body 10 between the second recess 22 and the fluid passage 18 is substantially uniform, as shown in FIG. 3A through FIG. 3D. The second recess 22 has its bottom portion 22*a*, which is the deepest portion, located near the axial center of the impeller 1. The deepest position of the bottom portion 21*a* of the first recess 21 is below an upper edge of the discharge port 14, and the deepest position of the bottom portion 22*a* of the second recess 22 is above a lower edge of the discharge port 14. A thick wall portion 25 is formed on a part of the upper-end surface 11 of the body 10. This thick wall portion 25 is a weight for balancing rotation of the impeller 1 which has an asymmetrical shape with respect to a central axis. The thick wall portion 25 is provided on a part of an outer circumferential surface of the boss 12.

A communication hole 23 is formed so as to provide fluid communication between the first recess 21 and the second recess 22. The communication hole 23 is a circular through-hole with a small diameter extending from the bottom portion 21*a* of the first recess 21 to the bottom portion 22*a* of the second recess 22. In this embodiment, plural communication holes 23 are formed in plural locations in the first recess 21. In the example shown in FIG. 2 and FIG. 3, two communication holes 23 are formed on both sides of the center of the impeller 1, i.e., one communication hole 23 is on one side and the other communication hole 23 is on the other side. Each communication hole 23 may extend in the axial direction from the bottom portion 21*a* of the first recess 21 to the bottom portion 22*a* of the second recess 22 as represented by a communication hole 23*a* shown in FIG. 3C, or may extend in a direction inclined slightly from the axial direction from the bottom portion 21*a* of the first recess 21 to the bottom portion 22*a* of the second recess 22 as represented by a communication hole 23*b*.

Arrangement of the communication holes 23 is not limited particularly so long as the communication holes 23 provide fluid communication between the first recess 21 and the second recess 22. It is preferable that the communication hole 23 be located in a position where the thinnest wall is formed between the bottom portion 21*a* of the first recess 21 and the bottom portion 22*a* of the second recess 22, as represented by the communication hole 23*a* shown in FIG. 3C. This arrangement can facilitate formation of the communication hole 23. The number and shape of communication holes 23 are not limited and may be different from those described in this embodiment.

Figure 4:
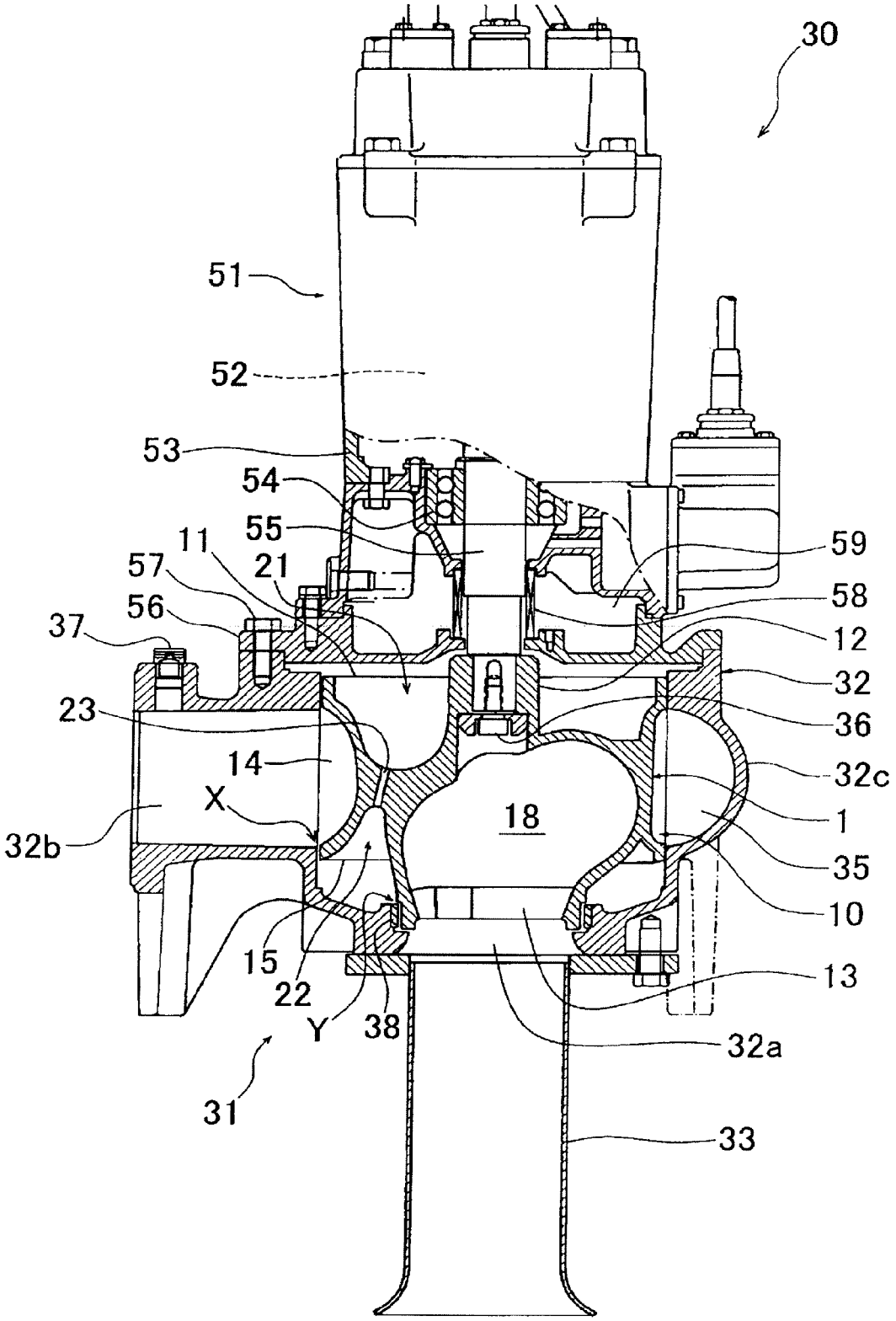
FIG. 4 is a cross-sectional view showing an example of a submersible pump having the pump impeller according to the embodiment of the present invention.

FIG. 4 is a cross-sectional view showing an example of the submersible pump 30 having the above-described impeller 1. The submersible pump 30 has a pump part 31 and a motor part 51. The pump part 31 includes the impeller 1 and a pump casing 32 covering the impeller 1. The motor part 51 includes an enclosed-type motor (submersible motor) 52 for rotating the impeller 1 and a motor casing 53 covering the motor 52. The motor 52 has a stator and a rotor (both are not shown in the drawings). A vertically-extending drive shaft 55 is mounted to a central portion of the rotor. The drive shaft 55 is rotatably supported by bearing 54. The impeller 1 in the pump casing 32 is secured to a lower end of the drive shaft 55, so that rotational driving force of the motor 52 is transmitted to the impeller 1.

The pump casing 32 has an inlet 32*a* and an outlet 32*b*. The pump casing 32 is secured to an intermediate casing 56 by bolt 57. The intermediate casing 56 is secured to a lower end of the motor part 51. A suction pipe 3, which extends downwardly, is coupled to the inlet 32*a* of the pump casing 32, and a discharge pipe (not shown), which has a lateral opening, is coupled to the outlet 32*b*. An air vent valve 37 is provided on an upper portion of the outlet 32*b*. A pump chamber 35 is formed in the pump casing 32. This pump chamber 35 is surrounded by a side wall 32*c*. The impeller 1 is installed in the pump chamber 35. The impeller 1 is any one of those shown in FIG. 1A, FIG. 1B, FIG. 2, and FIG. 3A to FIG. 3D. The boss 12 is secured to a lower end of the driving shaft 55 by bolt 36. The suction port 13 of the impeller 1 has an outer circumferential edge (i.e., an outer circumferential surface of a lower end of the cylindrical portion 13*a*), which faces an inner circumferential edge of a liner ring 38 attached to an inner circumferential surface of the inlet 32*a* of the pump casing 32. There is a small gap Y between the outer circumferential edge of the suction port 13 and the inner circumferential edge of the liner ring 38.

There is a small gap X between a lower part of the side surface 16 of the impeller 1 below the discharge port 14 and an inner circumferential surface of the pump casing 32. A small amount of sewage in the outlet 32*b* flows backward through the gap X into the second recess 22 and a region around the gap Y on the lower-end-surface side of the impeller 1. The gap X is slightly larger than the gap Y. There is also a small gap between an upper part of the side surface 16 above the discharge port 14 and the inner circumferential surface of the pump casing 32. Therefore, a small amount of the sewage in the outlet 32*b* flows through this gap into the first recess 21 and a region on the upper-end surface 11 of the body 10.

A mechanical seal 58 is provided between the pump part 31 and the motor part 51. This mechanical seal 58 is configured to seal a part of the driving shaft 55 in a gap between the pump part 31 and the motor part 51 to prevent pressurized liquid in the pump part 31 from leaking into the motor part 51. An oil chamber 59 is provided around the mechanical seal 58. An oil for lubricating and cooling the mechanical seal 58 is enclosed in the oil chamber 59.

Figure 5:
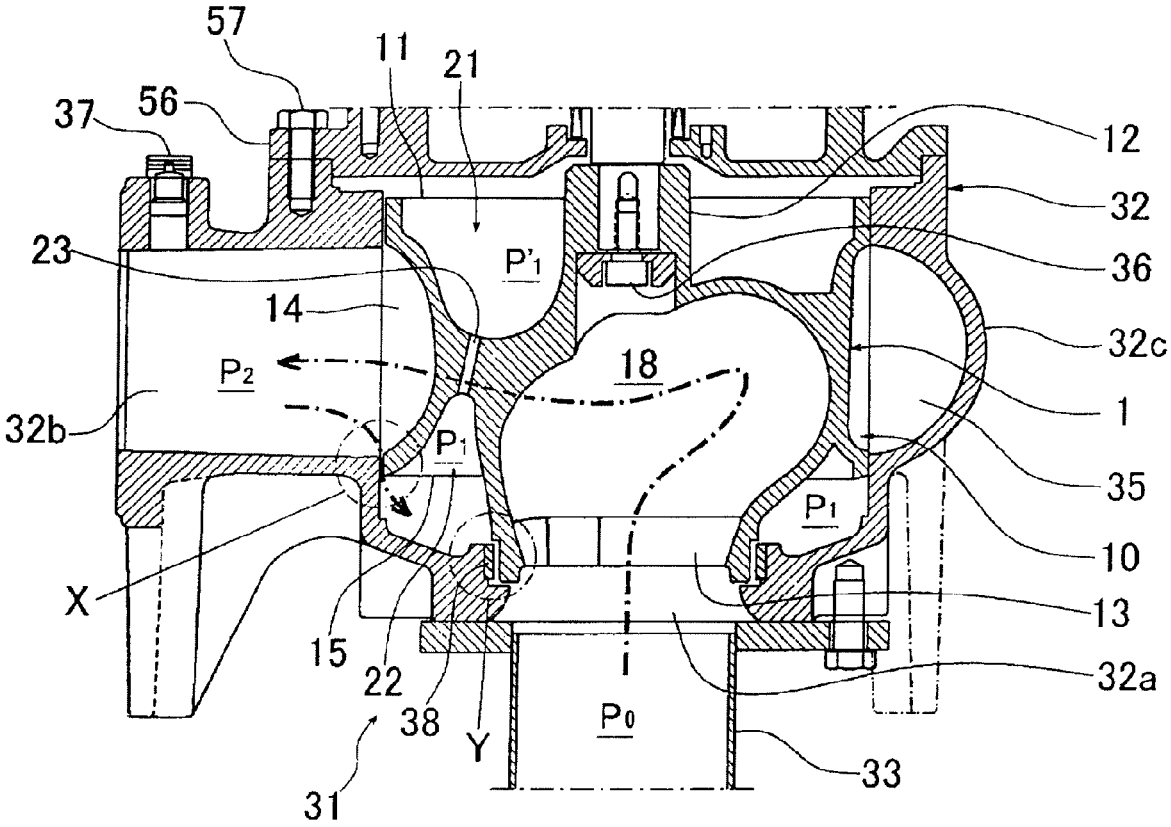
FIG. 5 is a view for illustrating flow of sewage in the submersible pump.

FIG. 5 is a view for illustrating the flow of the sewage in the submersible pump 30 and shows an enlarged cross-sectional view of a part of the pump part 31. In the above-described submersible pump 30, the drive shaft 55 is rotated by the motor 52 to rotate the impeller 1 in the pump casing 32. As the impeller 1 is rotated, the sewage is sucked from the inlet 32*a* of the pump casing 32 through the suction pipe 33 into the pump casing 32. The rotating impeller 1 imparts centrifugal force to the sewage in the pump casing 32 to thereby deliver the sewage from the suction port 13 to the discharge port 14 through the fluid passage 18 of the impeller 1. The sewage, which has reached the discharge port 14, is discharged from the outlet 32*b* of the pump casing 32.

The impeller 1 of the submersible pump 30 according to the embodiment has the first recess 21 on the upper-end surface 11 of the body 10 around the boss 12, the second recess 22 on the lower-end surface 15 around the suction port 13, and the communication hole 23 that connects the first recess 21 to the second recess 22 to provide fluid communication therebetween. In the pump casing 32 housing the impeller 1 therein, the sewage in the second recess 22 on the front-surface side of the impeller 1 is introduced into the first recess 21 on the rear-surface side through the communication hole 23. Therefore, the air pockets stuck in the first recess 21 and the rear-surface side of the impeller 1 are removed effectively. In this manner, failures that could be caused by the air pocket, such as idling of the pump or malfunction of the mechanical seal due to lack of lubrication, can be prevented in the submersible pump 30 with the non-clogging type impeller 1 having complicated end-surface geometry.

At least one communication hole 23 is provided. Preferably, plural communication holes 23 are provided, because the sewage can be introduced effectively through each communication hole 23 to thereby enhance the effect of air pocket removal. In the case where the communication hole 23 is inclined with respect to the axial direction as represented by the communication hole 23*b* shown in FIG. 3C, the sewage is discharged obliquely from the communication hole 23 by the rotation of the impeller 1, so that the sewage can spread in the first recess 21. Therefore, the sewage can remove the air pocket in the first recess 21 more effectively.

Furthermore, by providing the communication hole 23 in the impeller 1, it is possible not only to remove the air pocket, but also to prevent the foreign substances from being stuck in the gap Y. Specifically, relationship between pressure P0 in the inlet 32*a* and pressure P2 in the outlet 32*b* in FIG. 5 is P0<P2. Therefore, backflow from the high-pressure outlet 32*b* to the low-pressure inlet 32*a* is created in the gap X. Although the gap X is small, fine or thin foreign substances, such as very thin rubber product, are carried by the backflow into the second recess 22 through the gap X. If these fine foreign substances in the backflow are stuck in the gap Y between the impeller 1 and the pump casing 32, such foreign substances could be a cause of failure of the submersible pump 30.

To prevent such problem, the submersible pump 30 with the impeller 1 according to the embodiment has the communication hole 23 in the impeller 1. Since the communication hole 23 exists, pressure P1 in the region on the lower-end surface 15 of the impeller 1 and in the second recess 22 is approximately equal to pressure P1' in the region on the upper-end surface 11 and in the first recess 21. The relationship of pressure in this state is P1<P1'<P2. The difference between the pressure P1 and the pressure P2 on both sides of the gap X is small, compared with the case where the communication hole 23 does not exist. Therefore, the backflow of the sewage through the gap X decreases, and the foreign substances in the backflow are less likely to be stuck in the gap Y. As a result, failure of the submersible pump 30, such as malfunction, is reduced.

More specifically, the existence of the communication hole 23 can reduce the amount of the sewage flowing backward from the outlet 32*b* into the lower side of the impeller 1 through the gap X, as compared with conventional impeller. Because the backflow of the sewage delivers less foreign substances to the lower side of the impeller 1, the foreign substances is hardly stuck in the gap Y.

The communication hole 23 formed in the impeller 1 according to the embodiment is located so as to avoid the fluid passage 18 (or located beside the fluid passage 18) of the body 10 of the impeller 1 and extends from the upper-end surface 11 to the lower-end surface 15. The purpose of providing the communication hole 23 is different from that of a through-hole extending from a back side of an impeller to a fluid passage in a typical pump impeller because the through-hole is provided for reducing pressure difference between back-surface pressure (i.e., pressure on the back side of the impeller) and front-surface pressure (i.e., pressure on fluid passage surface).

The present invention is not limited to the embodiment as described above. It should be noted that various modification and other embodiments can be made within technical concept defined by claims, specification, and drawings. For example, while the lower-end surface 15 of the impeller 1 has the second recess 22 and the communication hole 23 connects the first recess 21 and the second recess 22 with each other in the above embodiment, the second recess 22 may be omitted. In this case, the communication hole 23 is formed so as to extend from the first recess 21 to the lower-end surface 15 of the body 10. In still another embodiment, the second recess 22 may be formed only on a part of the lower-end surface 15. In this case, the communication hole 23 may extend to a part of the lower-end surface 15 other than the second recess 22.

INDUSTRIAL APPLICABILITY

The present invention is applicable to an impeller capable of effectively removing air trapped in a region on a rear-surface side of the impeller and to a submersible pump having such impeller.

REFERENCE SIGNS LIST

1 impeller
10 body
11 upper-end surface (one end surface)
12 boss
13 suction port
14 discharge port
15 lower-end surface (the other end surface)
16 side surface
18 fluid passage
21 first recess
21*a* bottom portion
22 second recess
22*a* bottom portion
23 (23*a*, 23*b*) communication hole
30 submersible pump
31 pump part
32 pump casing
32*a* inlet
32*b* outlet
35 pump chamber
51 motor part
52 motor
53 motor casing
55 drive shaft
58 mechanical seal
X gap
Y gap

The invention claimed is:

1. A non-clogging type pump impeller, comprising:

an approximately cylindrical body having an attachment boss formed on a center of a first end surface of said approximately cylindrical body;

a suction port provided a second end surface of said approximately cylindrical body, said first end surface and said second end surface being arranged along an axial direction;

a discharge port having an opening on a side surface of said approximately cylindrical body; and a fluid passage provided in said approximately cylindrical body and connecting said suction port to said discharge port, said fluid passage having a vortex shape as viewed from the axial direction, wherein a recess is formed on said first end surface of said approximately cylindrical body so as to surround said attachment boss, said recess being sunk in the axial direction, and wherein said pump impeller has at least one communication hole providing fluid communication between said recess and a region on said second end surface of said approximately cylindrical body, said region being located outside said suction port.

2. The pump impeller according to claim 1, wherein said at least one communication hole comprises plural communication holes.

3. A submersible pump, comprising:

said pump impeller according to claim 1;

a pump casing housing said pump impeller therein; and a motor for driving said pump impeller.

4. The pump impeller according to claim 1, wherein said region is located radially outside said suction port.

5. The pump impeller according to claim 1, wherein said at least one communication hole is spaced apart from said fluid passage.

6. The pump impeller according to claim 1, wherein said at least one communication hole is not in direct communication with said fluid passage.

7. A non-clogging type pump impeller, comprising:

an approximately cylindrical body having an attachment boss formed on a center of a first end surface of said approximately cylindrical body;

a suction port provided on a second end surface of said approximately cylindrical body, said first end surface and said second end surface being arranged along an axial direction;

a discharge port having an opening on a side surface of said approximately cylindrical body; and a fluid passage provided in said approximately cylindrical body and connecting said suction port to said discharge port, said fluid passage having a vortex shape as viewed from the axial direction, wherein a first recess is formed on said first end surface of said approximately cylindrical body so as to surround said attachment boss, said first recess being sunk in the axial direction, wherein a second recess is formed on said second end surface of said approximately cylindrical body so as to surround said suction port, said second recess being sunk in the axial direction, and wherein said pump impeller has at least one communication hole providing fluid communication between said first recess and said second recess.

8. The pump impeller according to claim 7, wherein said at least one communication hole extends from a bottom portion of said first recess to a bottom portion of said second recess and is located in a position where a thinnest wall is formed between said bottom portion of said first recess and said bottom portion of said second recess.

9. A submersible pump, comprising:

said pump impeller according to claim 7;

a pump casing housing said pump impeller therein; and a motor for driving said pump impeller.

* * * * *